US009725681B2

(12) United States Patent
Peters et al.

(10) Patent No.: US 9,725,681 B2
(45) Date of Patent: Aug. 8, 2017

(54) AQUEOUS PROTEOLYTIC ENZYME-CONTAINING FORMULATION FOR THE CLEANING OF HARD SURFACES

(71) Applicant: L'AIR LIQUIDE, SOCIETE ANONYME POUR L'ETUDE ET L'EXPLOITATION DES PROCEDES GEORGES CLAUDE, Paris (FR)

(72) Inventors: Mike Peters, Hamburg (DE); Judith Heidel, Pinneberg (DE); Katrin Steinhauer, Hamburg (DE); Dana Kunde, Tangstedt (DE)

(73) Assignee: L'AIR LIQUIDE SOCIETE ANONYME POUR L'ETUDE ET L'EXPLOITATION DES PROCEDES GEORGES CLAUDE, Paris (FR)

( * ) Notice: Subject to any disclaimer, the term of this patent is extended or adjusted under 35 U.S.C. 154(b) by 0 days.

(21) Appl. No.: 15/021,720

(22) PCT Filed: Sep. 4, 2014

(86) PCT No.: PCT/EP2014/068812
§ 371 (c)(1),
(2) Date: Mar. 14, 2016

(87) PCT Pub. No.: WO2015/036312
PCT Pub. Date: Mar. 19, 2015

(65) Prior Publication Data

US 2016/0222317 A1 Aug. 4, 2016

(30) Foreign Application Priority Data

Sep. 13, 2013 (DE) ..... 10 2013 218 449

(51) Int. Cl.

| | |
|---|---|
| ***C11D 1/02*** | (2006.01) |
| ***C11D 1/66*** | (2006.01) |
| ***C11D 1/83*** | (2006.01) |
| ***C11D 3/33*** | (2006.01) |
| ***C11D 3/43*** | (2006.01) |
| ***C11D 3/48*** | (2006.01) |
| ***C11D 3/00*** | (2006.01) |
| ***C11D 3/20*** | (2006.01) |
| ***C11D 3/386*** | (2006.01) |
| ***C11D 11/00*** | (2006.01) |
| ***C11D 1/14*** | (2006.01) |
| ***C11D 1/22*** | (2006.01) |
| ***C11D 3/28*** | (2006.01) |

(52) U.S. Cl.
CPC ..... *C11D 3/0073* (2013.01); *C11D 1/146* (2013.01); *C11D 1/22* (2013.01); *C11D 1/662* (2013.01); *C11D 1/83* (2013.01); *C11D 3/2041* (2013.01); *C11D 3/2065* (2013.01); *C11D 3/2086* (2013.01); *C11D 3/28* (2013.01); *C11D 3/38618* (2013.01); *C11D 11/0029* (2013.01)

(58) Field of Classification Search
CPC .... C11D 1/02; C11D 1/66; C11D 1/83; C11D 3/0073; C11D 3/2041; C11D 3/2065; C11D 3/33; C11D 3/361; C11D 3/38618; C11D 3/43; C11D 3/48; C11D 7/5004; C11D 11/0023; C11D 11/0029
See application file for complete search history.

(56) References Cited

U.S. PATENT DOCUMENTS

| | | | | |
|---|---|---|---|---|
| 5,810,944 | A | 9/1998 | Smitkowski et al. | |
| 6,191,092 | B1 | 2/2001 | Bragulla et al. | |
| 6,235,692 | B1 * | 5/2001 | Scoville ..... | C11D 1/94 134/40 |
| 7,387,990 | B2 | 6/2008 | Dettmann et al. | |
| 2003/0206897 | A1 * | 11/2003 | O'Prey ..... | C12Y 304/21062 424/94.64 |
| 2007/0197422 | A1 | 8/2007 | Dettmann et al. | |
| 2009/0032058 | A1 | 2/2009 | McRae et al. | |
| 2010/0249005 | A1 * | 9/2010 | Thoele ..... | C11D 1/526 510/161 |

FOREIGN PATENT DOCUMENTS

| | | |
|---|---|---|
| DE | 19717329 | 10/1998 |
| DE | 102006006765 | 8/2007 |
| EP | 1081215 | 3/2001 |

OTHER PUBLICATIONS

International Search Report PCT/EP2014/068812 dated Feb. 4, 2015.

* cited by examiner

*Primary Examiner* — Charles Boyer
(74) *Attorney, Agent, or Firm* — Young & Thompson

(57) ABSTRACT

An aqueous formulation includes a) one or more proteolytic enzymes, b) one or more anionic surfactants, c) one or more non-ionic surfactants, d) one or more corrosion inhibitors, e) one or more multivalent aliphatic alcohols, f) one or more complexing agents, and g) one or more of para-hydroxybenzoic acid and esters thereof. The pH value of the formulation is in the range of from 9. to 12.5. The formulation is used in the mechanical cleaning of hard surfaces, in particular of medical instruments, and is preferably silicate free.

16 Claims, 8 Drawing Sheets

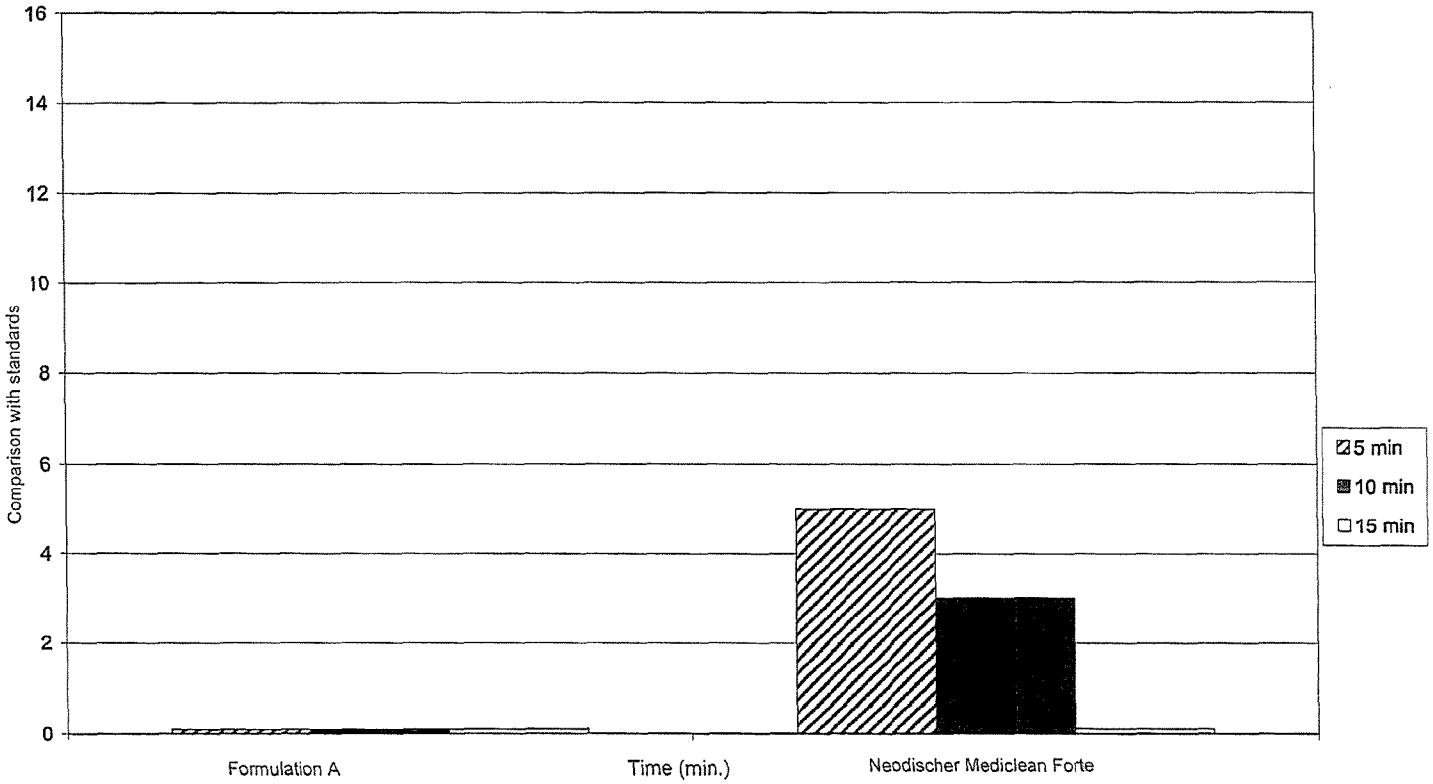
Fig.3a. Cleaning power visual

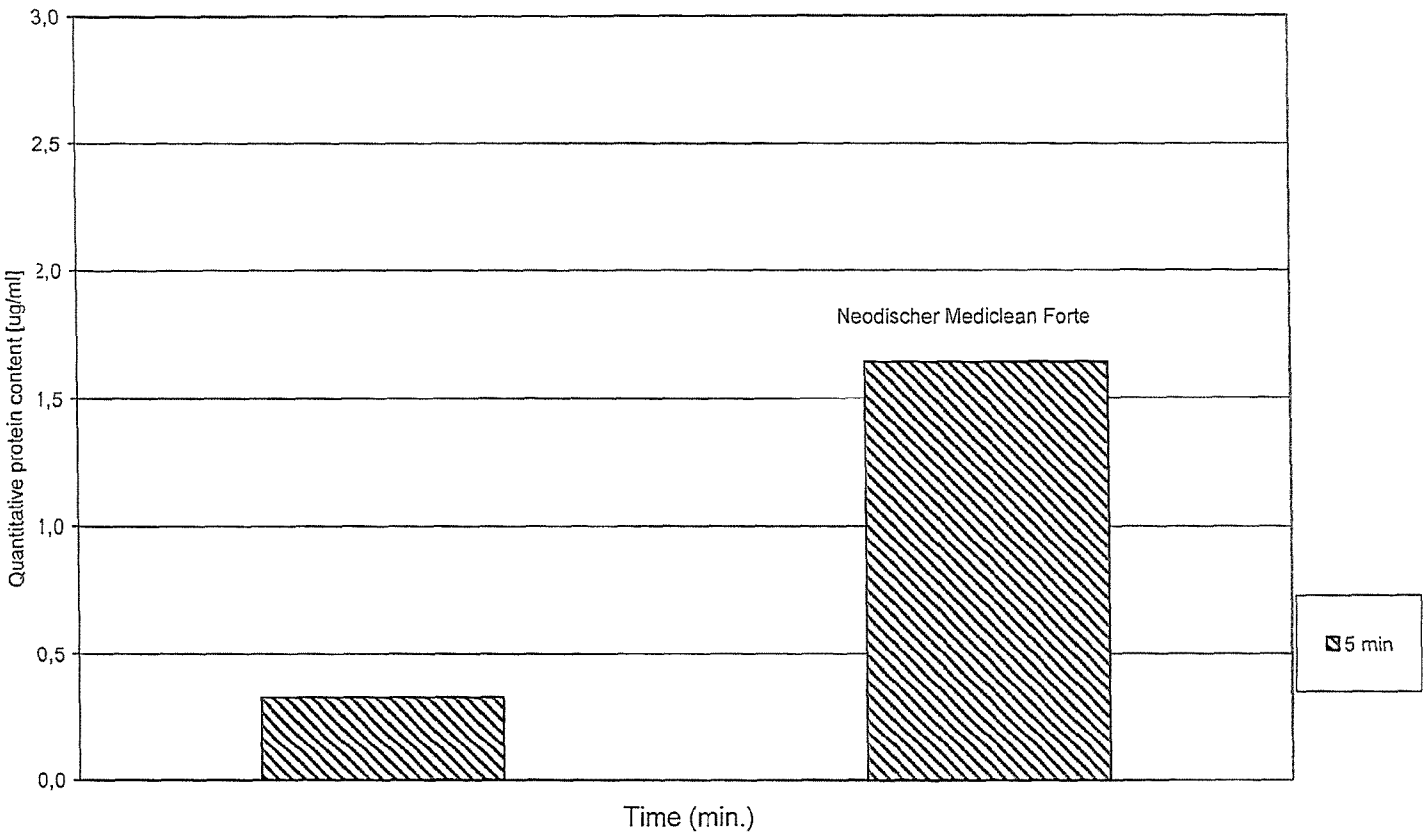
Fig.3b. Quantitative protein residue cleaning power

Fig. 4a. Cleaning power of various formulations at RT visual
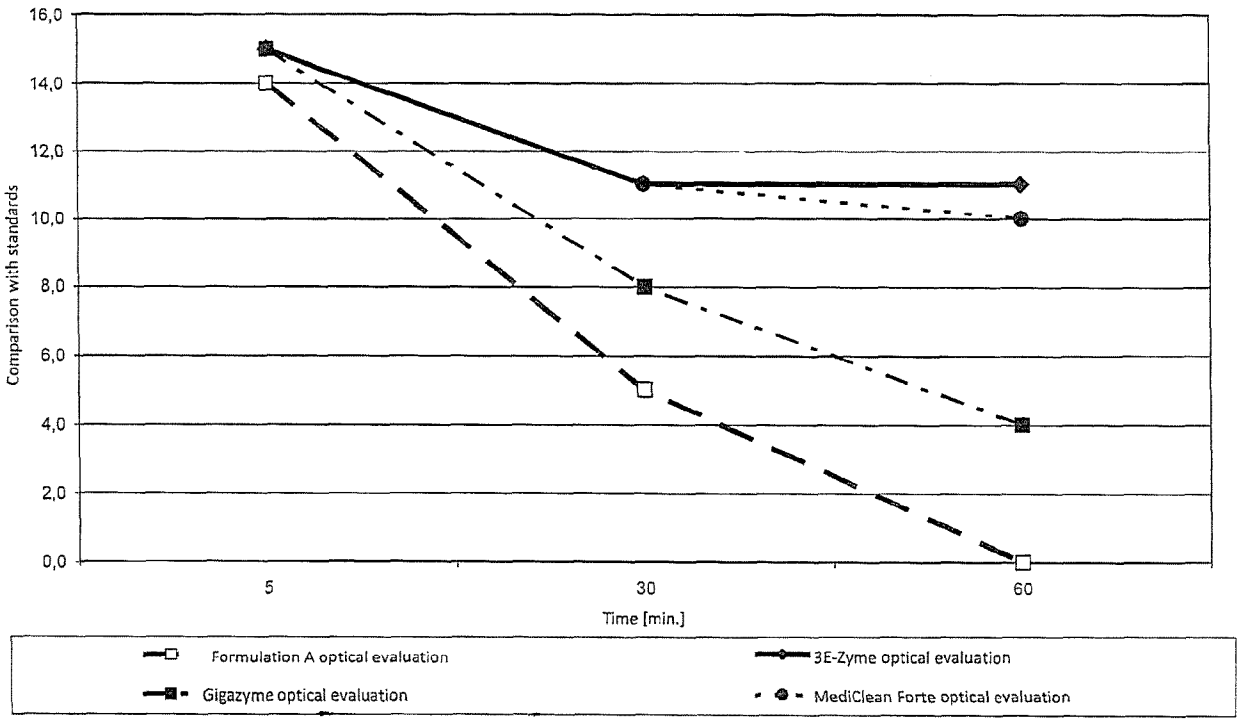

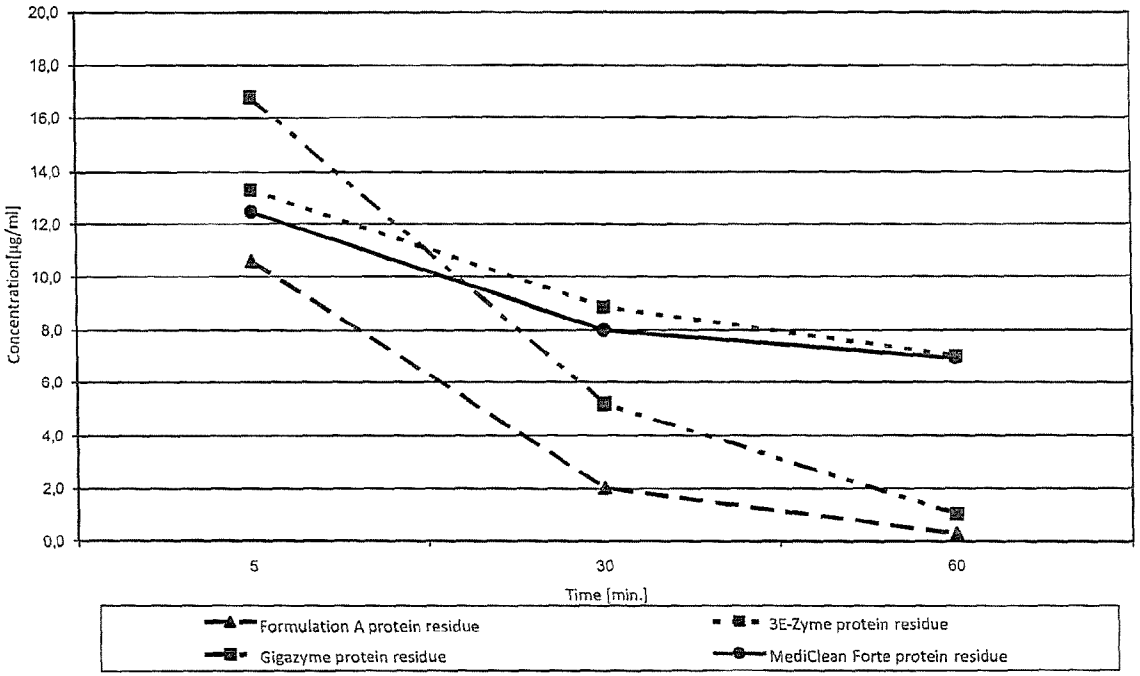
Fig. 4b. Cleaning power of various formulations at RT quantitative protein residue

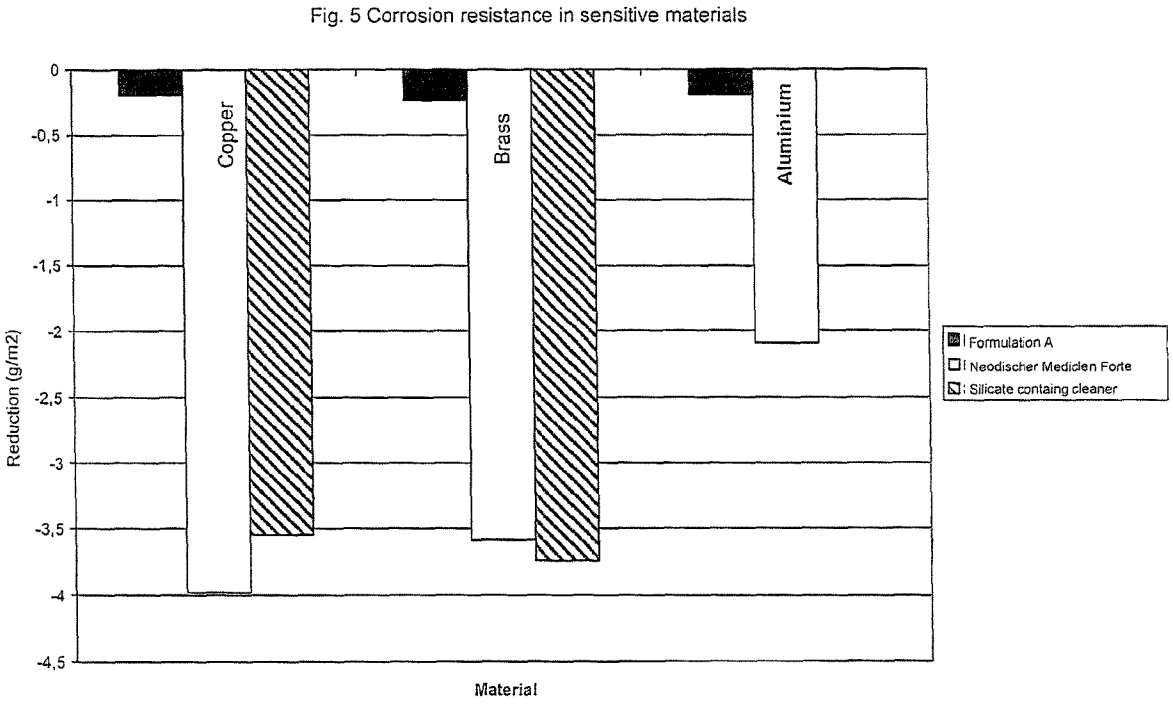
Fig. 5 Corrosion resistance in sensitive materials

AQUEOUS PROTEOLYTIC ENZYME-CONTAINING FORMULATION FOR THE CLEANING OF HARD SURFACES

The present invention relates to an aqueous formulation for the cleaning of hard surfaces. In addition, the invention relates to a method for the cleaning of hard surfaces, in particular of medical instruments in which the formulation is used.

According to the prior art, enzyme containing formulations are known for the mechanical cleaning of hard surfaces (such as for example plants for milk production and milk processing and of medical instruments including endoscopes). The enzymes in formulations of this type must nevertheless be stabilized.

DE 197 17 329 A1 discloses a liquid stabilized enzyme preparation and the use thereof for the cleaning of hard surfaces, in particular in plants for milk production and milk processing. Polyhexamethylene biguanide, N,N-bis-3-aminopropyl) dodecylamine, the salts thereof and mixtures of these amines are described in DE 197 17 329 A1 as stabilizers for the enzymes. The corrosion protection and the cleaning protection of the formulations according to DE 197 17 329 A1 should be improved still further.

EP 1 081 215 A1 describes a liquid enzyme containing cleaner concentrate with good storage stability and the application thereof, likewise for the cleaning of surfaces contaminated with milk.

In addition, the product neodisher MediClean forte of the Chemische Fabrik Dr. Weigert GmbH & Co. KG (Hamburg, Federal Republic of Germany) is known.

Enzyme containing formulations for the mechanical cleaning of instruments are frequently formulated as an alkali in order to improve its cleaning power. Alkaline formulations known in the prior art, however, are corrosive with respect to metals, i.e. they attack materials such as copper, brass and, in particular, aluminium in an undesired manner, which can be spoiled in the case of relatively complex medical instruments. Although the material durability of alkaline formulations can be improved by silicates being added, silicates nevertheless lead to undesired deposits and discoloration in the machine and also on the instruments to be cleaned. In addition, many enzymes with a high pH value have a tendency to decompose and must accordingly be stabilized. Finally, the addition of silicates is also undesired on environmental grounds.

Consequently, the object of the present invention is to make available formulations for the cleaning of hard surfaces which display an improved cleaning power. In addition, the formulations must have a low corrosiveness, so that they are suitable in particular for the cleaning of medical instruments (including endoscopes). The formulations should not necessarily contain silicate.

It has now surprisingly been found that this object is attained by an aqueous formulation which comprises a) one or more proteolytic enzymes, wherein the total quality of the component a), relative to the weight of the formulation, amounts to from 0.03 to 1.0% by weight, b) one or more anionic surfactants, wherein the total quality of the component b), relative to the weight of the formulation, amounts to from 0.5 to 15% by weight, c) one or more non-ionic surfactants, wherein the total quality of the component c), relative to the weight of the formulation, amounts to from 0.1 to 12% by weight, d) one or more corrosion inhibitors, wherein the total quality of the component d), relative to the weight of the formulation, amounts to from 0.050 to 1.0% by weight, e) one or more multivalent aliphatic alcohols, wherein the total quality of the component e), relative to the weight of the formulation, amounts to from 5.0 to 60% by weight, f) one or more complexing agents, wherein the total quality of the component f), relative to the weight of the formulation, amounts to from 0.1 to 15% by weight, and g) one or more of para-hydroxybenzoic acid and esters thereof, wherein the total quality of the component g), relative to the weight of the formulation, amounts to from 0.05 to 3.0% by weight, wherein the pH value of the formulation is in the range of from 9.5 to 12.5.

The formulations according to the invention are characterized in particular by

- a very good enzyme stability,
- a very good cleaning power (cf. the in vitro tests with TOSI test specimens),
- a very good cleaning power in the machine and
- a very good material durability as compared with formulations of the prior art.

In this case it is particularly advantageous for the material durability of special and preferred silicate free formulations according to the invention to be at least as good in accordance with corrosion tests as the material durability of silicate containing products of the prior art, i.e. the formulations according to the invention need not necessarily contain silicate.

With the aid of a newly developed method of determining the cleaning power it has been shown that formulations according to the invention lead to a significant improvement as compared with the prior art. This has been proven surprisingly both at room temperature and at the temperature of 55° C. customary for cleaning methods.

In a preferred formulation the proteolytic enzyme is selected from the group comprising Properase, Savinase and Esperase, in which case Esperase (such as Esperase 8.0 L) is particularly preferred as the component a).

It is preferable for the component a) to be present in a quantity of from 0.05 to 0.6% by weight, relative to the weight of the formulation, preferably in a quantity of from 0.1 to 0.4% by weight, such as for example 0.2% by weight.

In a preferred formulation the anionic surfactant is selected from alkyl sulphates, alkyl sulphonates, aryl sulphates and aryl sulphonates, the component b) preferably being alkyl sulphate and/or aryl sulphonate and the component b) in a particularly preferred manner being a mixture of alkyl sulphate with aryl sulphonate.

It is preferred for the component b) to be present in a quantity of from 1.0 to 12% by weight, relative to the weight of the formulation, preferably in a quantity of from 1.5 to 10.0% by weight, in particular from 2.0 to 8.0% by weight, such as for example 3 or for example 6% by weight.

In a preferred formulation the non-ionic surfactant is a fatty alcohol derivative, the fatty alcohol derivative preferably being selected from fatty alcohol alkoxylates and fatty alcohol glucosides. Surfactants of this type are sold for example under the trade names Plurafac and Lutensol by BASF SE, Ludwigshafen, Federal Republic of Germany, or under the trade name AG 6206 (Akzo Nobel, The Netherlands). Fatty alcohol alkoxylates used for alkaline cleaning agents are also known from DE 10 2006 006 765 A1.

It is preferable for the component c) to be present in a quantity of from 0.2 to 9.0% by weight, relative to the weight of the formulation, preferably in a quantity of from 0.4 to 6.0% by weight, in particular from 0.6 to 4.5% by weight.

In a preferred formulation the corrosion inhibitor is selected from 1H-benzotriazole and N,N-bis(2-ethylhexyl)-1H-1,2,4-triazol-1-methanamine.

It is preferable for the component d) to be present in a quantity of from 0.08 to 0.7% by weight, relative to the weight of the formulation, preferably in a quantity of from 0.15 to 0.4% by weight, in particular in a quantity of for example 0.2% by weight.

In a preferred formulation the multivalent aliphatic alcohol is selected from alkanediols and alkanetriols and mixtures thereof, the component e) preferably being a mixture of 1,2-propanediol with glycerol. It is preferable for the component e) to be present in a quantity of from 10 to 60% by weight, relative to the weight of the formulation, preferably in a quantity of from 15 to 50% by weight, in particular from 20 to 40% by weight.

In a preferred formulation the complexing agent is selected from nitrilotriacetic acid salts, phosphonobutane tricarboxylic acid salts, methylglycinediacetic acid salts and ethylenediaminetetraacetic acid salts. It is preferable for the component f) to be present in a quantity of from 0.5 to 6.0% by weight, relative to the weight of the formulation, preferably in a quantity of from 0.8 to 5.0% by weight, preferably in a quantity of from 1.0 to 4.0% by weight, in particular for example 3.0% by weight.

In a preferred formulation the ester of para-hydroxybenzoic acid is selected from methyl, ethyl, propyl and butyl ester of para-hydroxybenzoic acid. Para-hydroxybenzoic acid and the esters thereof (parabens) have inter alia an enzyme stabilizing effect.

In a preferred alternative the formulation contains para-hydroxybenzoic acid as the component g).

In a further preferred alternative the formulation contains one or more esters of para-hydroxybenzoic acid as the component g).

In a further alternative the formulation contains both i) para-hydroxybenzoic acid and ii) one or more esters of para-hydroxybenzoic acid as the component g), preferably both i) para-hydroxybenzoic acid and ii) a plurality of esters of para-hydroxybenzoic acid.

It is preferable for the component g) to be present in a quantity of from 0.1 to 2.0% by weight, relative to the weight of the formulation, preferably in a quantity of from 0.15 to 1.0% by weight, in particular from 0.2 to 0.7% by weight.

In a preferred formulation the quantity of water h) amounts to from 15 to 90% by weight, relative to the weight of the formulation, preferably from 20 to 85% by weight, more preferably from 25 to 80% by weight.

In a preferred formulation the pH value is in the range of from 10.0 to 12.5, preferably in the range of from 10.5 to 12.0.

A preferred formulation further comprises i) one or more dispersion agents, the dispersion agent preferably being a polyacrylic acid salt. It is preferable for the component i) to be present in a quantity of from 0.05 to 3.0% by weight, relative to the weight of the formulation, preferably in a quantity of from 0.10 to 2.0% by weight, in particular from 0.3 to 0.6% by weight, such as for example 0.45% by weight.

A preferred formulation further comprises j) one or more pH value regulators, the pH value regulator preferably being selected from monoethanolamine, triethanolamine and alkali hydroxide solution.

A further preferred formulation further comprises k) one or more univalent aliphatic alcohols, the univalent aliphatic alcohol preferably being selected from methanol, ethanol, n- and i-propanol, in particular ethanol.

A preferred formulation further comprises 1) one or more further enzymes, the further enzymes preferably being selected from the group of lipases, cellulases, amylases and mannanases.

It is preferable for the formulation to contain less than 6.0% by weight of silicate, indicated as $SiO_2$ and relative to the weight of the formulation, preferably less than 4.0% by weight of silicate, indicated as $SiO_2$ and relative to the weight of the formulation, in particular less than 2.0% by weight of silicate, indicated as $SiO_2$ and relative to the weight of the formulation, such as less than 1.0% by weight of silicate, indicated as $SiO_2$ and relative to the weight of the formulation, it being particularly preferred for the formulation to contain substantially no silicate.

In a further embodiment the invention relates to a method for the mechanical cleaning of hard surfaces (in particular of medical instruments, including endoscopes), in which the formulation according to any one of the preceding claims is used. The hard surface is therefore preferably a medical instrument, in particular an endoscope.

The formulation according to the invention is a concentrate which is typically used in the form of an aqueous dilution, for example in a dilution of from 0.5 to 20 ml of the concentrate per litre of the stock solution ready for the application.

In a first embodiment of the method according to the invention, which in particular is suitable for thermostable hard surfaces, the procedure is as follows:

a) pre-rinsing with water at a maximum of 45° C. for a period of from 1 to 5 min,
b) cleaning with an aqueous dilution of the formulation according to the invention (typically in a concentration in the range of from 1 to 10 ml/l, such as for example 5 ml/l) with the temperature rising to a maximum of 95° C. for a period of from 2 to 30 min in total,
c) rinsing,
d) final rinsing with water,
e) thermal disinfection at a temperature of at least 90° C. for a period of from 1 to 20 min, and
f) drying.

The invention will be described in connection with the attached drawings, in which.

Figure 6:
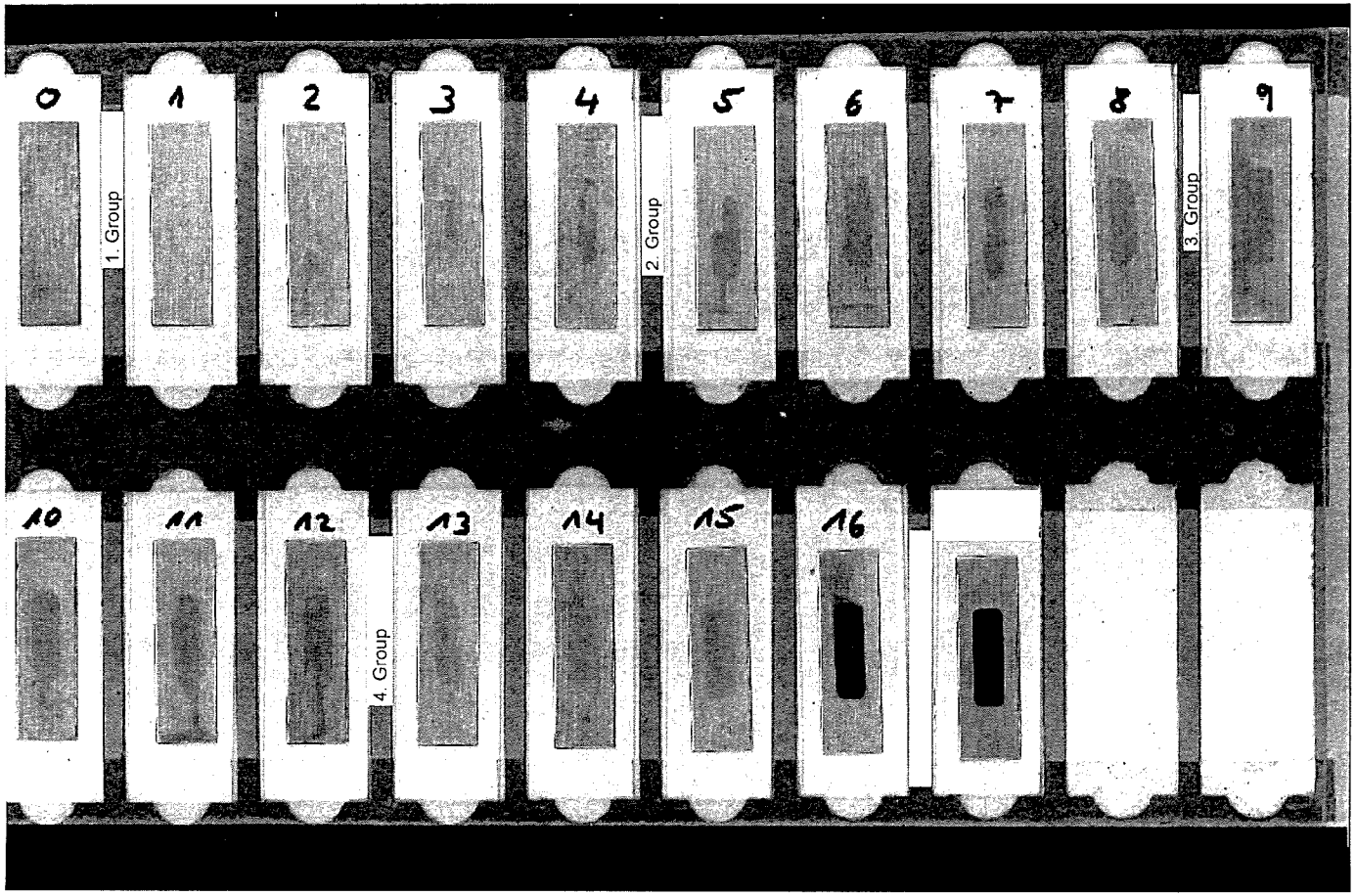

FIGS. 3*a* and 3*b* show cleaning power in accordance with method B (TOSI method)—visual, and cleaning power in accordance with method B (TOSI method)—quantitative protein residue, respectively;

FIGS. 4*a* and 4*b* show comparison of the cleaning power of various formulations at RT in accordance with method B-visual; and comparison of the cleaning power of various formulations at RT in accordance with method B-quantitative protein residue, respectively;

FIG. 5 is a plot illustrating material durability in accordance with method A; and FIG. 6 is an image of the samples of each group.

In the case of this first embodiment of the method according to the invention the rinsing c) can be a rinsing with water, and a (common) rinsing step c) and d) is then possibly sufficient. Alternatively, the rinsing c) can be carried out with a neutralization solution.

Figure 1:
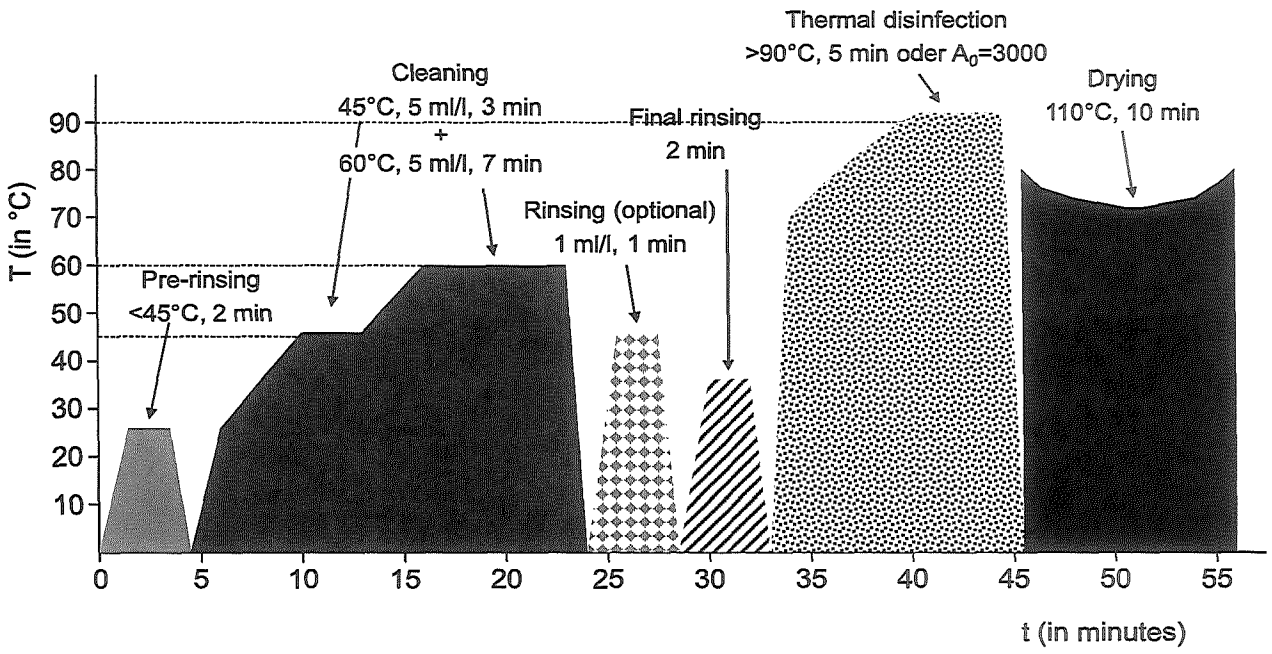
FIG. 1 shows the successive steps a) to f) in a typical method.

An example of a typical method according to the invention of this sort is illustrated in FIG. 1, which shows the successive steps a) to f).

In a second embodiment of the method according to the invention, which in particular is suitable in the case of thermolabile hard surfaces, the procedure is as follows:

a) pre-rinsing with water at a maximum of 45° C. for a period of from 1 to 5 min,
b) cleaning with an aqueous dilution of the formulation according to the invention (in a concentration in the range of from 1 to 10 ml/l, typically for example 5 ml/l) with the temperature rising to a maximum of 60° C. for a period of from 2 to 30 min in total,
c) rinsing with water,
d) chemothermal disinfection at a temperature rising to a maximum of 60° C. for a period of from 5 to 25 min in total,
e) final rinsing with water, and
f) drying.

Figure 2:
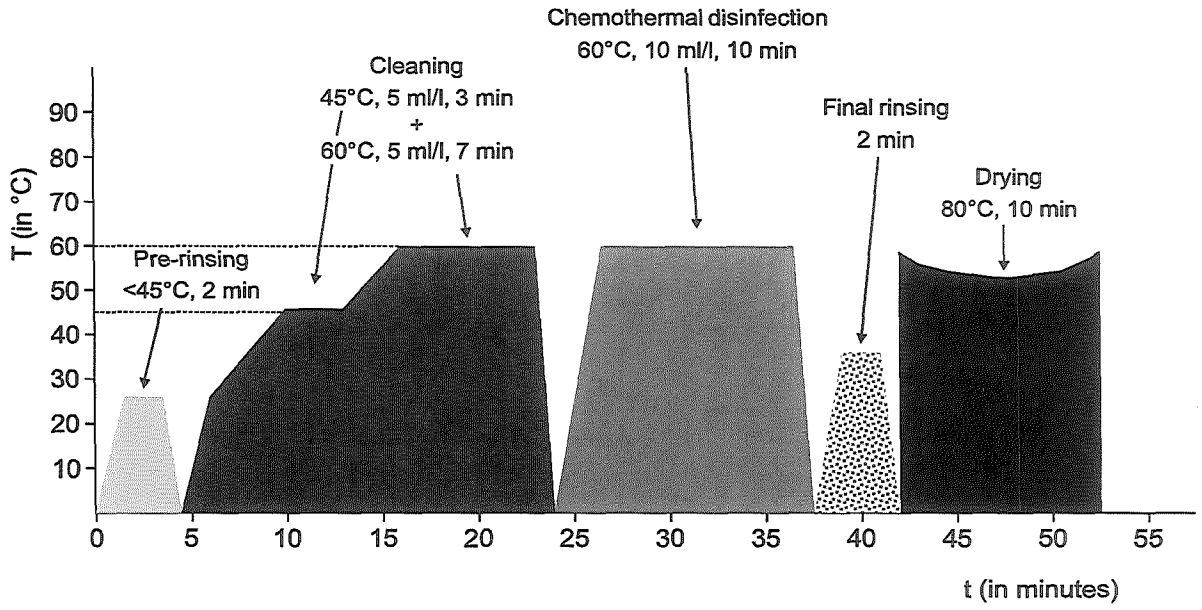
FIG. 2 shows the successive steps a) to f) (step c) not shown) in connection with another embodiment.

An example of a typical method of this sort is illustrated in FIG. 2, which shows the successive steps a) to f) (step c) not shown).

The advantages of the present invention may be seen in particular in the following examples. Unless indicated otherwise, all the percentages refer to the weight.

EXAMPLES

Method A

Determination of the Corrosion Behaviour with Respect to Metals

In the test, standard test sheets are used which are immersed up to 60% into the test solutions, so that an evaluation of the test bodies in the region of the immersion phase, the gas phase by way of the solution and in the boundary phase of the two becomes possible.

Test Bodies of Copper, Brass and Aluminium

Test Conditions

The following conditions were set for the corrosion test (Table 1):

TABLE 1

| Parameters | Standard |
|---|---|
| Immersion depth of the test body | 60% |
| Temperature | 60° C. |
| Immersion time | 24 hours |
| Concentration of the test solution | 0.5% |

Test Solution

In each case the pH value of the test solution is measured and documented. The test solutions are poured into 400 ml beakers.

Preparation of the Test Bodies

The test bodies are wiped with a cellulose cloth. For cleaning purposes the test bodies are immersed in acetone/petroleum ether/petroleum ether in succession and are allowed to dry in the air in each case.

Introduction of the Test Bodies

The prepared test bodies are weighed on an analytical balance, provided with glass hooks and carefully immersed into the test solution as far as the 60% mark. The beakers are then covered with suitable foil and are stood for 24 hours in the water bath set to a temperature of 60° C.

Removal of the Test Bodies

After the removal of the beakers from the water bath the test bodies are removed from the test solution. The test bodies are carefully rinsed with VE water and then cleaned by immersion in acetone/petroleum ether/petroleum ether and are dried.

Evaluation

The dried test bodies are weighed again on the analytical balance. The weight difference and the reduction/increase can now be calculated in $g/m^2$.

The measurement uncertainty is $\pm 0.1$ $g/m^2$.

Method B

Determination of the Cleaning Power by Means of TOSI-Test Bodies and Quantitative Determination of Protein According to Bradford The method is used to determine the cleaning power of cleaning solutions for the preparation of medical instruments (IDA=instrument disinfection agents). TOSIs (Test Object Surgical Instruments), the test contamination of which correlates with human blood, are used as the test bodies.

The test can be carried out in the form of a static test in order to simulate the behaviour of the manual preparation of instruments, or in the form of a dynamic test in order to illustrate the cleaning power in the mechanical preparation.

In this method the quantitative determination of the protein film remaining on the test body and the Roti-Nanoquant reagence follows the visual evaluation after the cleaning test. On the basis of the determination of the protein according to Bradford [M. Bradford, (1976) *Anal. Biochem.* 72:248 to 254. U. Niess, (2004) *J Bacteriol.* 186:3640 to 3648] the proteins are demonstrated in this case with the dye Coomassie Brilliant Blue G 250.

The choice of the concentration of the cleaning solution, the quality of water used (demineralized, softened, tap water or the like), the duration of the cleaning test and the test temperature are selected in each case after the use of the product in practice.

Materials, chemicals and appliances required magnetic stirrers, possibly with a water bath attached thermostat
beakers, high shape, 250 ml and 100 ml
magnetic stirrer rod
weighting rings
umbilical cord clamps
apparatus for the suspension of the umbilical cord clamp
Eppendorf pipette P5000 and P1000 with corresponding pipette tips
pH meter
test tube 15 ml with cover
shaker
tweezers
400 ml beaker with softened water
digital camera
TOSI test bodies (Order No. 8302, BAG Health Care, Lich, Germany)
alarm clock
glass beads
disposable cuvettes
cuvette paddles (for thorough mixing)
disposable pipettes
NaOH solution, 0.5 mol/1

HCl solution, 0.5 mol/1
buffer pH 7.00 (Merck)
albumine serum fraction V (Serva)
Roti-Nanoquant (Roth)
photometer (590 nm and 450 nm)

A 20% solution is produced in softened water from the Roti-Nanoquant solution. This dilution is capable of being kept for a week in a refrigerator.

Performance of the Cleaning Tests a) Static Cleaning Test

The beakers (100 ml, high shape) are filled without foam with approximately 100 ml of the test solution to be tested. The TOSI test bodies are placed in the solution with a pair of tweezers with the test dirt layer at the top. After the end of the test period the TOSI test bodies are removed from the solution with the tweezers and are rinsed by immersion and turning in VE water. The TOSI test bodies are then dried standing upright in the air.

After that, an optical evaluation of the TOSI test bodies is carried out according to groups and where appropriate sub-groups as compared with the comparison TOSI test bodies previously set (standard). The TOSI test bodies are photographed with a digital camera for documentation. The pictures are later copied into the evaluation sheets. Each TOSI test body can now be evaluated analytically with the Bradford method.

b) Dynamic Cleaning Test

The beakers (250 ml, high shape) are filled with 200 ml of the cleaning solution to be tested, provided with a magnetic stirrer rod. When a water bath is used the beakers are weighted with a lead ring. After that, they are placed on the stirrer (usually step 3) at room temperature or on the stirrer into the water bath set to the test temperature.

At the beginning of the test the TOSI test bodies are removed from the packaging and from the plastics material holding means, placed in a suitable holding means (for example an umbilical cord clamp) and are suspended centrally in the beaker with the cleaning solution. After the end of the test period the TOSI test bodies are removed from the solution with the tweezers and are rinsed by immersion and turning in VE water. The TOSI test bodies are then dried standing upright in the air.

After that, an optical evaluation of the TOSI test bodies is carried out according to groups and/or sub-groups as compared with the relevant standard TOSI test bodies defined before the start of the test. The TOSI test bodies are photographed with a digital camera for documentation. The pictures are later copied into the evaluation sheets. Each TOSI test body can be evaluated analytically after that with the Bradford method.

Setting the Cleaning Standard Series for the Qualitative Evaluation

A cleaning standard series was set up for the reproducible visual evaluation of the TOSI test bodies. To this end, cleaned test bodies were divided into groups and sub-groups.

A cleaning series with different removal times of the TOSI test bodies was carried out with a 0.5% solution of a commercially available alkaline enzymatic cleaner: The removal times were after 10 s, 20 s, 30 s, 40 s, 50 s, 60 s, 70 s, 80 s, 90 s, 100 s, 110 s, 120 s, 240 s, 270 s, 330 s, 360 s and 600 s.

A plurality of sub-groups were formed for the clear reproducibility of the appearance (see Table 2 and FIG. 6).

TABLE 2

| Group | Sub-group |
|---|---|
| A (no residues) | 0 |
| B (few residues) | 1-4 |
| C (almost complete range with residues) | 5-8 |
| D (complete range with residues, slightly yellow) | 9-12 |
| E (almost complete residues, entire covering) | 13-16 |
| F (test body with the test contamination not cleaned) | 17 |

The cleaning standard series allows a very good qualitative evaluation—which thus always turns out to be the same, irrespective of the assessing person, and is therefore readily capable of being compared—from the subjective assessment. The sample of each group are shown on the photography according to FIG. 6.

Quantitative Determination of Protein with Roti-Nanoquant According to Bradford 5 ml of 0.5 M NaOH solution with approximately from 10 to 15 glass beads are introduced in each case into a 15 ml test tube, the closed test tubes are kept in a water bath at a temperature of approximately 55° C., one TOSI test body is introduced in each case into a test tube and is vigorously shaken with the shaker until all the residues are dissolved.

5 ml of 0.5 M HCl solution are introduced into the respective test tubes with the 0.5 M NaOH solution, the TOSI test body and the glass beads, and the TOSI test body is rinsed with the 5 ml of 0.5 M HCl solution; the test body is then removed from the test tube and is disposed of.

The solution from the test tube is set to pH 7.0±0.1 by the addition of 5 ml of buffer solution of pH 7.0. For the blank value, 5 ml of 0.5 M NaOH solution, 5 ml of 0.5 M HCl solution and 5 ml of buffer solution of pH 7.0 are mixed in a 30 ml glass and are set to the pH value of 7.0±0.1.

Then, 400 μl of the solution set (or of the blank value) and 1600 μl of the 20% Roti-Nanoquant solution are introduced into a cuvette and are mixed. After a 5 min reaction time the samples are measured photometrically. To this end, a zero equalization is first carried out with water at 590 nm, and then the blank value and the sample are likewise measured at 590 nm. After that, the zero equalization is carried out at 450 nm and the measurements are carried out.

Evaluation:

Protein μg/ml=$(E_{sample590\ nm}/E_{sample450\ nm}-E_{blank\ value590\ nm}/E_{blank\ value\ 450\ nm})$/increase of the lines Calibration of the Quantification of Protein In order to set a calibration line various BSA concentrations are used (BSA: bovine serum albumin). To this end, a stock solution is set with a concentration of 400 μg/ml of BSA in VE water. Solutions with a concentration of 10 μg/ml and 100 μg/ml are produced from this. The dilution series is produced from these two solutions (see Table 3).

TABLE 3

| BSA [μg/ml] | μl from BSA dilution | μl of demineralized water |
|---|---|---|
| 0 | — | 400 |
| 1 | 40 μl from 10 μg/ml | 360 |
| 2.5 | 100 μl from 10 μg/ml | 300 |
| 5 | 200 μl from 10 μg/ml | 200 |
| 10 | 40 μl from 100 μg/ml | 360 |
| 25 | 100 μl from 100 μg/ml | 300 |
| 50 | 200 μl from 100 μg/ml | 200 |
| 75 | 300 μl from 100 μg/ml | 100 |
| 100 | 200 μl from 400 μg/ml | 600 |

The preparation of the calibration solutions is carried out in a cuvette. To this end, 400 al of the corresponding BSA concentration solution (see Table 3) is mixed with 1600 al of the 20% Roti-Nanoquant solution and is intermixed by a cuvette paddle.

After a 5 min reaction period in the cuvette a zero equalization with water is first carried out at 590 nm on a photometer and the calibration solutions are then measured. The calibration solutions and also the zero equalization with water are likewise measured at the wavelength 450 nm. The quotient of the two extinctions (590 nm/450 nm) is formed, and the degree of calibration is set with the quotient.

Formulations

Neodisher MediClean forte of the Chemische Fabrik Dr. Weigert GmbH & Co. KG (Hamburg, Federal Republic of Germany) is a silicate free, alkaline, enzyme containing cleaner.

The constituents used in the formulations and the active contents thereof are listed below (Table 4).

TABLE 4

| | Constituent | Aktive content/% |
|---|---|---|
| a | esperase 8.0 L | 9 |
| b1 | cumene sulphonic acid sodium salt | 40 |
| b2 | sodium ethylhexyl sulphate | 42 |
| c1 | fatty alcohol glucoside | 75 |
| c2 | fatty alcohol ethoxylate butoxylate | 100 |
| c3 | fatty alcohol propoxylate ethoxylate | 100 |
| d | 1H-Benzotriazole | 100 |
| e1 | propylene glycol (1,2-propanediol) | 100 |
| e2 | glycerol (1,2,3-propanetriol) | 85 |
| f | methylglycinediacetic acid trisodium salt | 40 |
| g1 | para-hydroxybenzoic acid | 100 |
| g2 | mixture of methylparaben, ethylparaben, propylparaben, butylparaben | 28 (dissolved in phenoxyethanol) |
| h | purified water | — |
| i | polyacrylic acid sodium salt | 45 |
| j1 | triethanolamine | 100 |
| j2 | aqueous potassium hydroxide solution | 45 |
| j3 | ethanolamine | 100 |
| k | ethanol, 1% yellowed with MEK | 94 |

The quantities of the constituents used in the individual formulations tested are listed below (Table 5).

TABLE 5

| Constituent | A/% | B/% | C/% | D/% |
|---|---|---|---|---|
| a | 2.0 | 2.0 | 2.0 | 2.0 |
| b1 | 7.5 | 13.0 | 13.0 | 13.0 |
| b2 | — | 2.5 | 2.5 | 2.5 |
| c1 | 1.7 | — | 4.5 | — |
| c2 | 0.5 | 0.5 | 0.5 | — |
| c3 | — | 0.5 | — | 0.5 |
| d | 0.2 | 0.2 | 0.2 | 0.2 |
| e1 | 20 | 18.0 | 18.0 | 18.0 |
| e2 | 23 | 21.0 | 21.0 | 21.0 |
| f | 7.5 | 7.5 | 7.5 | 7.5 |
| g1 | 0.5 | — | — | — |
| g2 | — | 0.8 | 0.8 | 0.8 |
| h | 27.1 | 30.5 | 25.45 | 29.95 |
| i | 1.0 | 1.0 | 1.0 | 1.0 |
| j1 | 3.0 | — | 3.0 | 3.0 |
| j2 | 1.0 | — | 0.55 | 0.55 |
| j3 | — | 2.5 | — | — |
| k | 5.0 | — | — | — |

Results I

Formulation A and the commercially available cleaner Neodisher Mediclean Forte (alkaline, enzyme containing, silicate free) were investigated in accordance with method B (at 55° C.) and the results shown in FIG. 3*a* and FIG. 3*b* were obtained.

FIG. 3*a:*

Cleaning power in accordance with method B (TOSI method)—visual. The various formulations were investigated according to the recommended application concentrations of 0.5% after the exposure times indicated (5, 10, 15 min). The residual contamination shown on the TOSI test bodies was evaluated according to method B, visual evaluation with the aid of the standard panel. The investigations were carried out in the form of a dynamic test at the usual process temperature of 55° C. A commercially available alkaline cleaner (neodisher Mediclean forte, Chemische Fabrik Dr. Weigert GmbH & Co. KG) was taken jointly as a reference product.

FIG. 3*b:*

Cleaning power in accordance with method B (TOSI method)—quantitative protein residue. The various formulations were investigated according to the recommended application concentrations of 0.5% after the exposure time indicated (5 min). The residual contamination shown on the TOSI test bodies after the exposure time indicated is indicated in μg/ml. In this case a high residual contamination indicates a poor cleaning result and a low value a slight residual contamination. The investigations were carried out in the form of a dynamic test at the usual process temperature of 55° C. A commercially available alkaline cleaner (neodisher Mediclean forte, Chemische Fabrik Dr. Weigert GmbH & Co. KG) was taken jointly as a reference product.

Results II

Formulation A and commercially available cleaners (namely i) gigazyme (non-alkaline), ii) 3E-zyme (non-alkaline) and iii) neodisher Mediclean Forte (alkaline, enzyme containing, silicate free) were investigated in accordance with method B (at RT=room temperature). The results shown in FIG. 4*a* and FIG. 4*b* were obtained.

FIG. 4*a:*

Comparison of the cleaning power of various formulations at RT in accordance with method B—visual. The various formulations were investigated according to the recommended application concentrations after the exposure times indicated (5, 10, 15 min). The residual contamination shown on the TOSI test bodies was evaluated in accordance with method B, visual evaluation with the aid of the standard panel. The investigations were carried out in the form of a dynamic test at the usual process room temperature. The following commercially available formulations were used as reference products for the mechanical and manual cleaning of medical instruments in the recommended application concentration: (neodisher Mediclean forte, Chemische Fabrik Dr. Weigert GmbH & Co. KG: 0.5%; gigazyme, Schülke & Mayr GmbH: 1%; 3E-Zyme, Medisafe: 0.75%).

FIG. 4*b*: Comparison of the cleaning power of various formulations at RT in accordance with method B—quantitative protein residue. The various formulations were investigated according to the recommended application concentrations after the exposure times indicated (5, 10, 15 min). The residual contamination shown on the TOSI test bodies after the exposure time indicated is indicated in μg/ml. In this case a high residual contamination indicates a poor cleaning result and a low value a slight residual contamination. The investigations were carried out in the form of a dynamic test at the usual process room temperature. The following commercially available formulations were used as reference products for the mechanical and manual cleaning of medical instruments in the recommended application concentration: (neodisher Mediclean forte, Chemische Fabrik Dr. Weigert GmbH & Co. KG: 0.5%; gigazyme, Schülke & Mayr GmbH: 1%; 3E-Zyme, Medisafe: 0.75%).

These results show the advantages of the formulation according to the invention as compared with the three comparison formulations tested in the visual evaluation and in the quantitative determination of the protein residue.

Results III

Formulation A, the commercially available cleaner neodisher Mediclean Forte (alkaline, enzyme containing, silicate free) and a commercially available silicate containing cleaner (alkaline, enzyme containing) were tested in accordance with method A with demineralized water. The results are shown in Table 6 and in FIG. 5, which is a graphical representation of said results.

TABLE 6

| Change in weight in g/m$^2$ | | | |
|---|---|---|---|
| | copper | brass | aluminium |
| Formulation A | −0.2 | −0.24 | −0.20 |
| Neodisher Mediclean Forte | −3.98 | −3.59 | −2.09 |
| silicate containing cleaner | −3.55 | −3.74 | 0 |

FIG. 5: Material durability in accordance with method A. In this illustration the corrosion resistance in particular of materials known to be sensitive such as copper, brass and aluminium with respect to various mildly alkaline formulations is shown. The reduction rate is shown in g/m$^2$ after a contact time of 24 h. The following commercially available mildly alkaline cleaners were taken jointly as reference products: neodisher Mediclean forte, Chemische Fabrik Dr. Weigert GmbH & Co. KG; thermosept alka clean forte, Schülke & Mayr GmbH.

The results show the advantages of formulation A according to the invention both as compared with the silicate free formulation and as compared with the silicate containing formulation.

The invention claimed is:

1. Aqueous formulation which comprises:

a)—One or more proteolytic enzymes, wherein the total quantity of the component a), relative to the weight of the formulation, amounts to from 0.03 to 1.0% by weight, b)—One or more anionic surfactants, wherein the total quantity of the component b), relative to the weight of the formulation, amounts to from 0.5 to 15% by weight, c)—One or more non-ionic surfactants, wherein the total quantity of the component c), relative to the weight of the formulation, amounts to from 0.1 to 12% by weight, d)—One or more corrosion inhibitors, wherein the total quantity of the component d), relative to the weight of the formulation, amounts to from 0.050 to 1.0% by weight, e)—One or more multivalent aliphatic alcohols, wherein the total quantity of the component e), relative to the weight of the formulation, amounts to from 5.0 to 60% by weight, f)—One or more complexing agents, wherein the total quantity of the component f), relative to the weight of the formulation, amounts to from 0.1 to 15% by weight, and g)—one or more of para-hydroxybenzoic acid and the esters thereof, wherein the total quantity of the component g), relative to the weight of the formulation, amounts to from 0.05 to 3.0% by weight, wherein the pH value of said aqueous formulation is in the range of from 9.5 to 12.5.

2. Formulation according to claim 1, wherein the proteolytic enzyme is selected from the group consisting of Properase, Savinase and Esperase.

3. Formulation according to claim 1, wherein the component a) is present in a quantity of from 0.05 to 0.6% by weight, relative to the weight of the formulation.

4. Formulation according to claim 1, wherein the component b) is present in a quantity of from 1.0 to 12% by weight, relative to the weight of the formulation.

5. Formulation according to claim 1, wherein the component c) is present in a quantity of from 0.2 to 9.0% by weight, relative to the weight of the formulation.

6. Formulation according to claim 1, wherein the component d) is present in a quantity of from 0.08 to 0.7% by weight, relative to the weight of the formulation.

7. Formulation according to claim 1, wherein the component e) is present in a quantity of from 10 to 60% by weight, relative to the weight of the formulation.

8. Formulation according to claim 1, wherein the component f) is present in a quantity of from 0.5 to 6% by weight, relative to the weight of the formulation.

9. Formulation according to claim 1, wherein the component g) is present in a quantity of from 0.1 to 2.0% by weight, relative to the weight of the formulation.

10. Aqueous formulation according to claim 1, which comprises:

a)—From 0.05 to 0.6% by weight, relative to the weight of the formulation, of one or more proteolytic enzymes, selected from the group consisting of Properase, Savinase and Esperase;

b)—From 1.0 to 12% by weight, relative to the weight of the formulation, of one or more anionic surfactants, selected from the group consisting of alkyl sulphates, alkyl sulphonates, aryl sulphates and aryl sulphonates;

c)—From 0.2 to 9.0% by weight relative to the weight of the formulation of one or more non-ionic surfactants, selected from the group consisting of fatty alcohols alkoxylates and fatty alcohol glucosides, d)—From 0.08 to 0.7% by weight, relative to the weight of the formulation, of one or more corrosion inhibitors, selected from the group consisting of 1H-benzotriazole and N,N-bis(2-ethylhexyl)-1H-1,2,4-triazol-1-methanamine;

e)—From 10 to 60% by weight, relative to the weight of the formulation, of one or more multivalent aliphatic alcohols selected from the group consisting of alkanetriols and alkanediols;

f)—From 0.5 to 6% by weight, relative to the weight of the formulation, of one or more complexing agents selected the group consisting of from nitrilotriacetic acid salts, phosphonobutane tricarboxylic acids salts, methylglycinediacetic acid salts and ethylenediaminetetracetic acid salts, and g)—From 0.1 to 2.0% by weight, relative to the weight of the formulation, of one or more of para-hydroxybenzoic acid and the esters thereof selected from the group consisting of methyl, ethyl, propyl and butyl esters of para-hydroxybenzoic acid.

11. Formulation according to claim 1, wherein the quantity of water h) amounts to from 15 to 90% by weight.

12. Formulation according to claim 1, which it further comprises i) one or more dispersion agents.

13. Formulation according to claim 1, which it further comprises k) one or more univalent aliphatic alcohols.

14. Method for the mechanical cleaning of hard surfaces, comprising the step of cleaning said hard surface with an aqueous dilution of the formulation according to claim 1, said dilution being at a concentration in the range of from 0.5 to 20 ml/l.

15. Method according to claim 14, wherein the hard surface is a medical instrument.

16. Method according to claim 15, wherein said medical instrument is an endoscope.

* * * * *